United States Patent [19]

Taylor-Smith

[11] 4,245,451

[45] Jan. 20, 1981

[54] AUTOMATIC METHOD AND APPARATUS FOR LAYING BLOCK UNITS

[76] Inventor: Ernest J. Taylor-Smith, 2905 W. 37th Ave., Vancouver, British Columbia, Canada V6N 2T8

[21] Appl. No.: 920,165

[22] Filed: Jun. 29, 1978

Related U.S. Application Data

[62] Division of Ser. No. 733,155, Oct. 18, 1976, Pat. No. 4,106,259.

[51] Int. Cl.[3] ..... E04G 21/22

[52] U.S. Cl. ..... 52/747; 264/261; 425/63; 414/38; 414/110

[58] Field of Search ..... 52/745, 747, 749; 264/261; 425/63

[56] References Cited

U.S. PATENT DOCUMENTS

| | | | |
|---|---|---|---|
| 3,640,046 | 2/1972 | Anderson et al. | 52/749 |
| 4,067,766 | 1/1978 | Larger | 52/747 |

FOREIGN PATENT DOCUMENTS

| | | | |
|---|---|---|---|
| 565639 | 8/1975 | Switzerland | 52/749 |
| 1395811 | 5/1975 | United Kingdom | 52/749 |

*Primary Examiner*—J. Karl Bell

*Attorney, Agent, or Firm*—Larson, Taylor and Hinds

[57] ABSTRACT

Method and apparatus for automatically laying block units, such as bricks or concrete blocks, to form a wall-like structure. The block units are successively positioned beneath a gripping head which picks up each block unit and deposits it on a table which is mounted for lateral movement and for movement normal to this lateral movement. After each block is placed on the table, the latter is shifted laterally a block length until a course of block units is formed, after which the table is shifted a block height in the direction normal to the course. Then a second course of block units is formed against the first course of units. These operations are continued until a wall-like structure of predetermined dimensions is formed.

4 Claims, 10 Drawing Figures

AUTOMATIC METHOD AND APPARATUS FOR LAYING BLOCK UNITS

Figure 1:
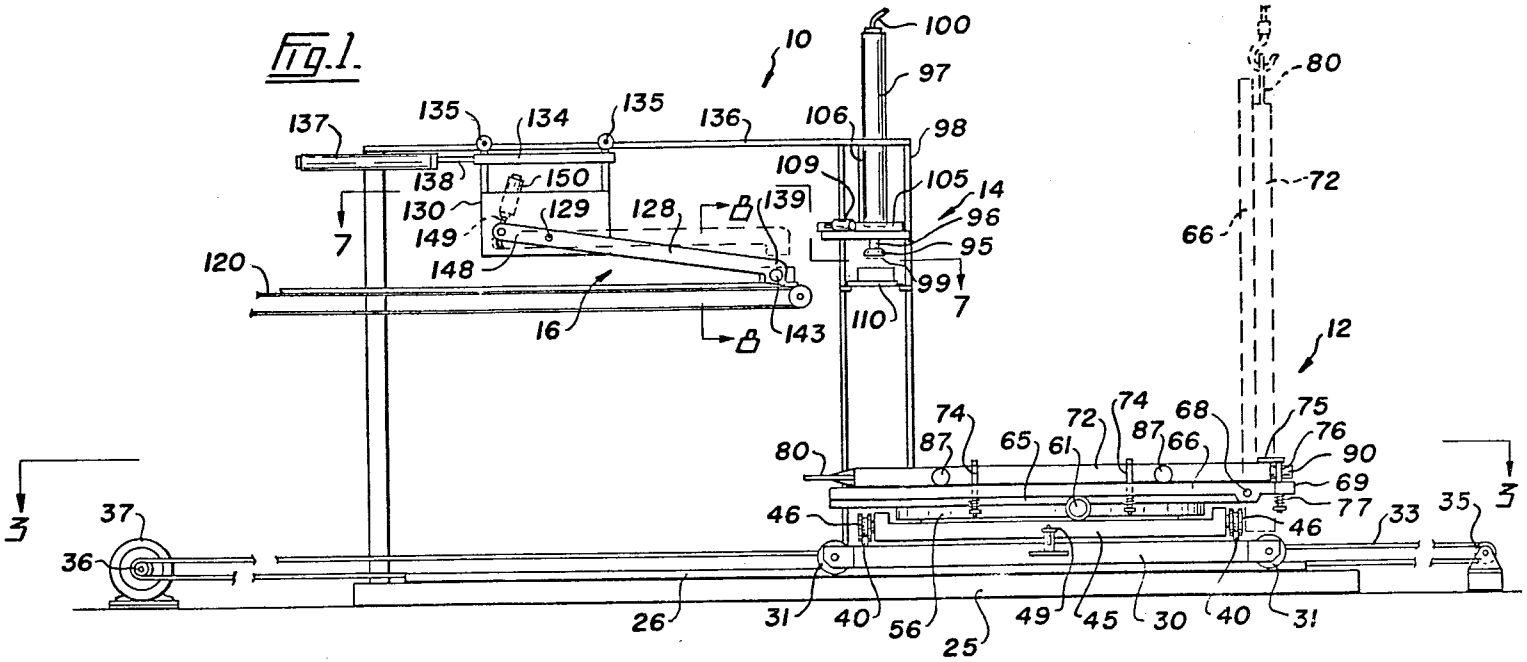

This is a division of application Ser. No. 733,155 filed Oct. 18, 1976 now U.S. Pat. No. 4,106,259.

This invention relates to a method of and apparatus for automatically laying block units for form wall-like structures of predetermined dimensions.

This invention is primarily concerned with forming walls of block units, such as bricks and concrete blocks, by laying these units in courses. Although this method can be used to form a wall in a vertical position, it is preferable to form the wall horizontally within a frame, after which the wall is transported to the desired site and elevated to the vertical position. When required, the wall is formed with openings, such as window and door openings, therein. The block units are laid in straight courses and/or in curved courses. Mortar or other bonding material is inserted between adjacent ends of the block units as they are being consecutively laid, and mortar or other bonding material is placed between the courses as they are being formed. If desired, cables can be laid between courses and then prestressed. The mortar can be applied manually or automatically, and it may be in the form of mortar-like gaskets. This invention is concerned with the laying of the block units, and the actual mortar or mortar-like gasket application and the cable prestressing from the subject matter of one or more additional applications.

Where wall panels are constructed of block units, such as concrete blocks or bricks, the standard technology requires the manual services of a mason for the laying of such blocks and bricks in superimposed disposition to form courses one above the other and with mortar applied between them to cement them together to form the wall or panel structure. Previous automatic machines for the laying of blocks, bricks or the like into a wall structure using mortar to cement the blocks together have been unsatisfactory in that they provided a poor mortar bond, left random portions of the mortar on the faces of the blocks after they had been mortared together and assembled into panels. Mortar applied to bricks or blocks by automatic means must cover all of the horizontal areas of the blocks, and the mortar must be applied in controlled quantities and distributed evenly to avoid excessive mortar extruding from joints or adhering to vertical surfaces of the wall or panel.

Previous attempts at automating have been limited to the laying of block into bond patterns like stack or running bond. These attempts have also endeavoured to set up the laying apparatus immediately at the placement or erection site of the panel or wall with resultant serious deficiencies and inabilities in obtaining and maintaining levels, alignment, support and working area for the machinery and the mortar agent application, particularly in confined areas or where the work height levels involved require scaffolding, not to mention the difficulties encountered during severe or extremely cold weather conditions. There is a need for a machine which will automatically and at a high rate of speed lay blocks, bricks or the like, mortar them in straight and/or circular alignments into a panel or wall structure, having any necessary apertures accommodated during the automatic laying of the blocks, so that a very strong bond is created between the blocks and the mortar, to provide a durable panel assembly which can be readily transported and hoisted into place in a building structure.

The method of automatically laying block units in accordance with the present invention comprises picking up a block unit by a gripping head, placing said block unit against a table, making a relative lateral shift between the head and the table to clear the head from the placed block unit, picking up another block unit by the head and placing it beside the first-mentioned block unit, continuing the picking up and placing operation until a predetermined number of block units are placed side by side in a first course, making a relative shift between the head and the table in the direction normal to said lateral shift, continuing the picking up and placing operation to form a second course of block units against said block units of said first course, and continuing the picking up and placing operation to form a predetermined number of courses to form a wall-like structure of said block units of predetermined dimensions.

Apparatus in accordance with this invention for automatically laying block units comprises a table mounted for lateral movement and movement normal to said lateral movement and having a block unit receiving surface, means for depositing block units on the receiving surface, means connected to the table to shift said table in said lateral movement after block units are placed thereon to enable a course of block units to be formed on the table, and means connected to the table to shift said table in said normal movement to enable a plurality of courses of said block units to be formed on the table.

In general terms, block units are successively and intermittently moved into an exact position where each one is gripped by a gripping head. A table which is mounted for lateral movement and movement normal thereto, is shifted into position beneath the gripped block, following which the block is deposited on the table. While the next block unit is being gripped, the table is shifted laterally so that the next block is deposited at the end of the previously-deposited block. Mortar is placed against the adjacent ends of these blocks in any desired manner, and the last-mentioned block is shifted back towards the first block far enough to leave only the desired thickness of mortar therebetween. This operation and lateral movement is continued until a lateral course or a wall of predetermined dimensions is laid. After the last block of the course is moved into position, the table is shifted in the direction normal to the first course, after which another course is laid in the described manner. These operations are continued until a wall of the desired dimensions has been created. The table has a frame which surrounds the wall, and the sides and ends of the frame can be adjusted relative to each other so as to retain the block in the laid positions thereof. The frame containing the blocks can now be picked up and moved to the curing area, and then stored or moved to a site where the finished wall is required for building purposes.

All or part of the table may consist of a rotatably mounted panel so that it can be rotated after each block is laid to enable blocks to be placed in a curved course.

Although it is preferred to mount the table so that it can be moved in the two directions normal to each other, it is to be understood that the gripping head and its associated mechanism may be mounted for the two-directional and curved movements, in which case the table can remain stationary. This can be done by mounting the gripping head on a table-like structure which is mounted for movement in the same manner as the first-mentioned table herein.

Although the apparatus described and illustrated herein is particularly adapted to carry out the present method, the method itself is important. It may be carried out by other forms of apparatus.

The method of automatically laying block units in accordance with this invention comprises picking up a block unit by a gripping head, placing said block unit against a table, making a relative lateral shift between the head and the table to clear the head from the placed block unit, picking up another block unit by the head and placing it beside the first-mentioned block unit, continuing the picking up and placing operation until a predetermined number of block units are placed side by side in a first course, making a relative shift between the head and the table in the direction normal to said lateral shift, continuing the picking up and placing operation to form a second course of block units against said block units of said first course, and continuing the picking up and placing operation to form a predetermined number of courses to form a wall-like structure of said block units of predetermined dimensions.

The apparatus for carrying out the method according to the present invention comprises a table mounted for lateral movement and movement normal to said lateral movement and having a block unit receiving surface, a head mounted for movement towards and away from said table surface, gripping means on said head operable to grip a block unit, delivering means for moving block units successively into position to be gripped by said gripping means, means connected to the head to move said head and a gripped block unit to place said block unit on the receiving surface, means connected to the table to shift said table in said lateral movement after block units are placed thereon to enable a course of block units to be formed on the table, and means connected to the table to shift said table in said normal movement to enable a plurality of courses of said block units to be formed on the table.

Figure 2:
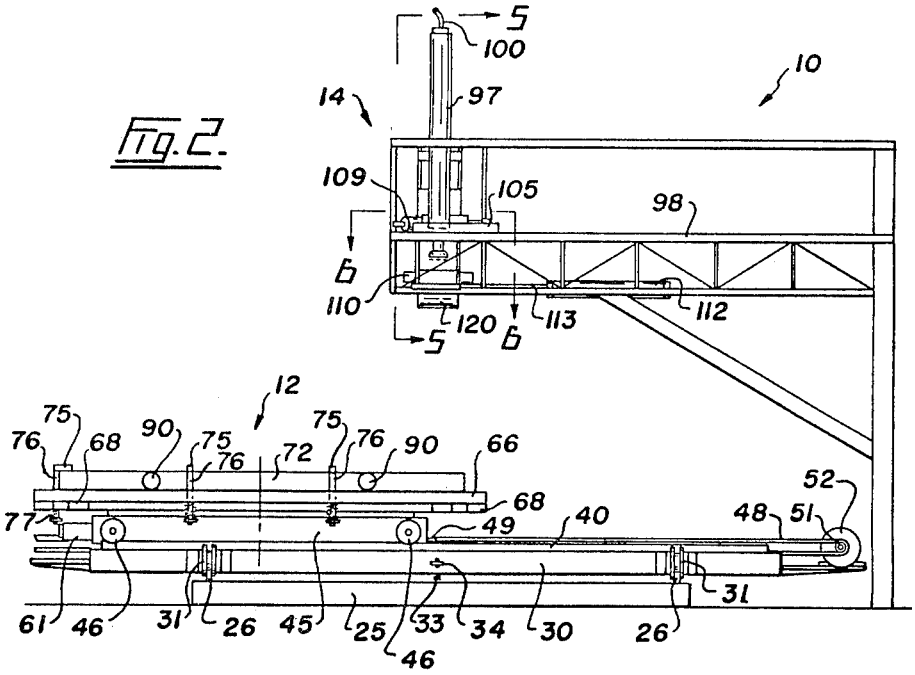
Figure 4:
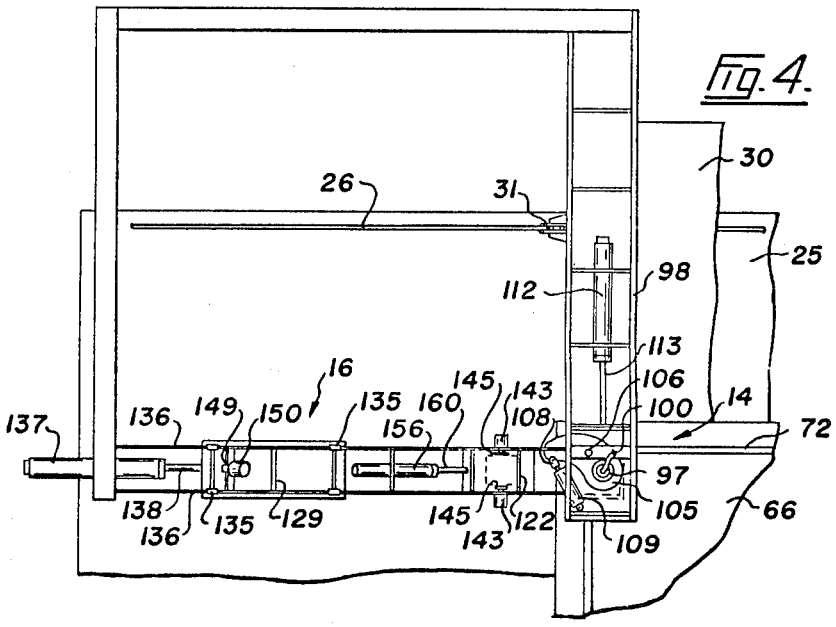
Figure 3:
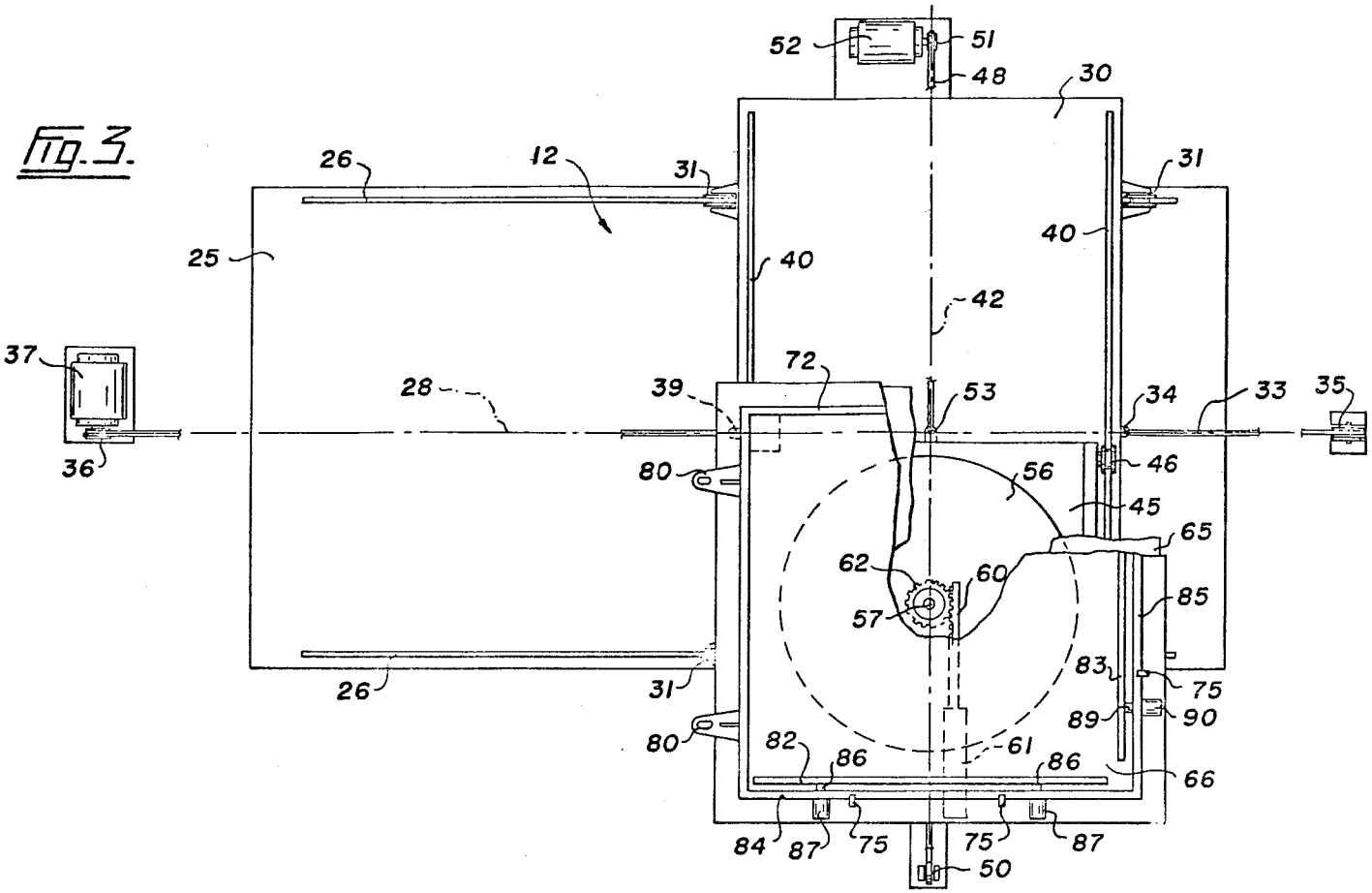
Figure 5:
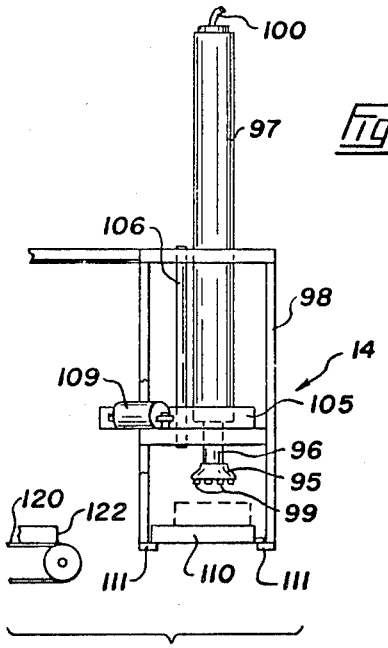
Figure 6:
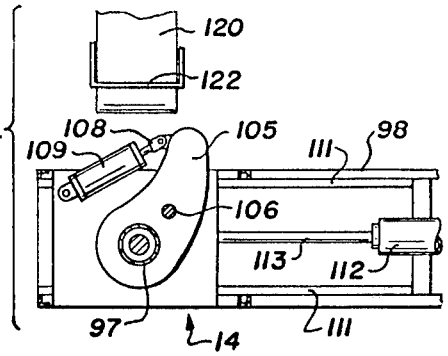
Figure 7:
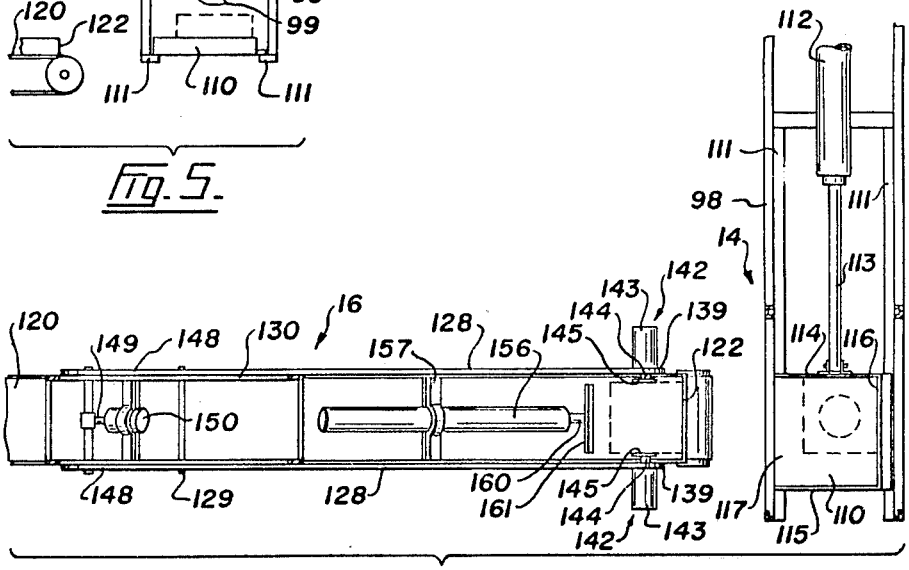
Figure 8:
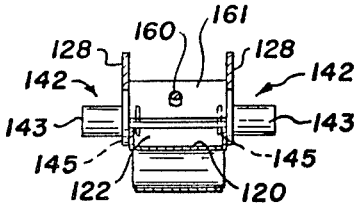
Figure 9:
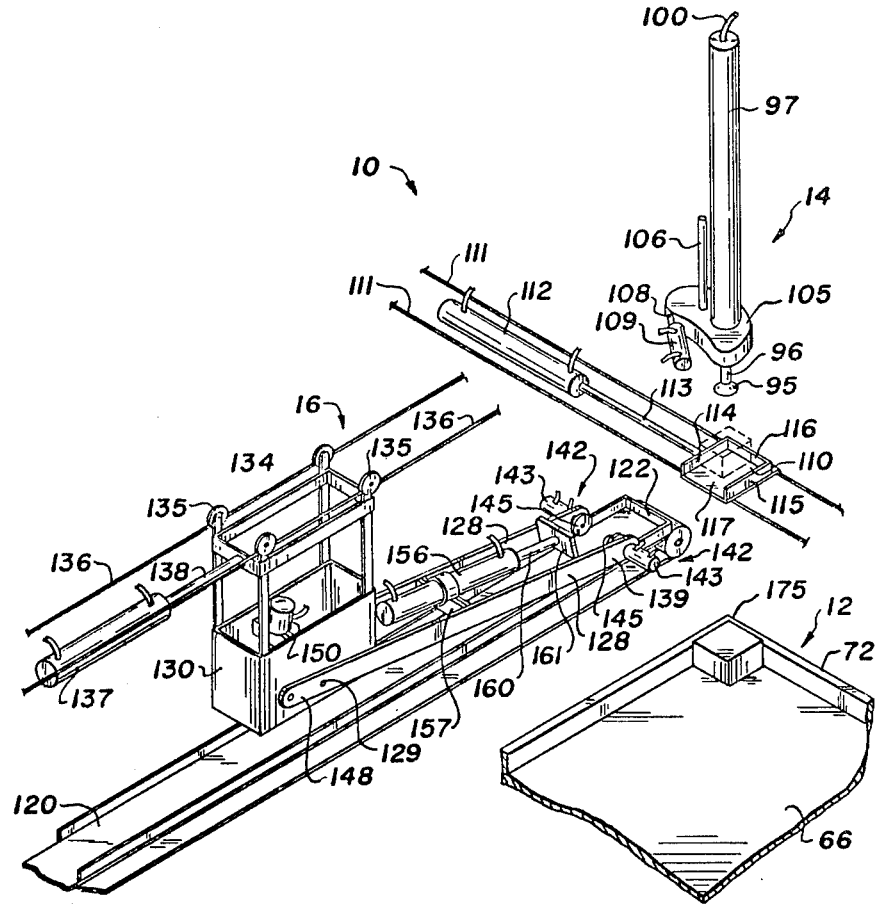
Figure 10:
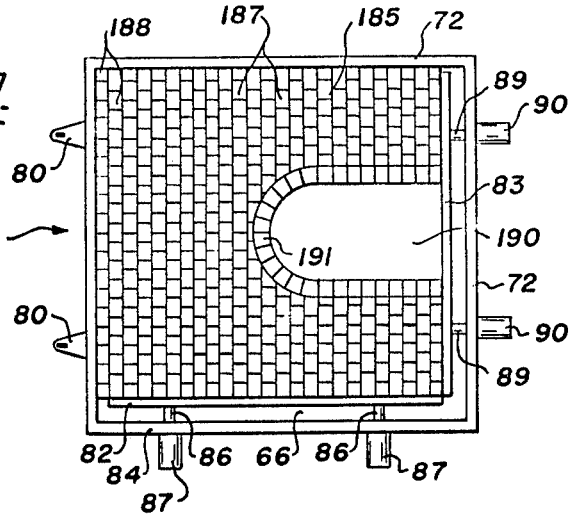

A preferred form of apparatus for carrying out this invention is illustrated in the accompanying drawings, in which:

FIG. 1 is a side elevation of this block laying apparatus,

FIG. 2 is an end elevation of the apparatus as viewed from the right of FIG. 1, FIG. 3 is a plan view of the table assembly as viewed from line 3—3 of FIG. 1, FIG. 4 is a plan view of the apparatus with the table assembly broken away, FIG. 5 is an enlarged fragmentary section taken on the line 5—5 of FIG. 2, FIG. 6 is an enlarged horizontal section taken on the line 6—6 of FIG. 2, FIG. 7 is a horizontal section taken on the line 7—7 of FIG. 1, FIG. 8 is an enlarged section taken on the line 8—8 of FIG. 1, FIG. 9 is a diagrammatic perspective view of a portion of the apparatus, showing block feeding assembly and the block placing assembly, and FIG. 10 illustrates one type of wall formed on the table assembly

GENERAL DESCRIPTION

Referring to the drawings, 10 is apparatus in accordance with this invention for automatically laying blocks to form wall-like structures. This apparatus is made up generally of a table assembly 12, a block placing assembly 14 and a block feeding assembly 16.

The table assembly 12 is designed to receive blocks in succession and intermittently to shift laterally so as to create courses of the blocks, and to shift at right angles thereto to form successive courses. The blocks are generally placed in line to form a course, and the lines of blocks are arranged parallel to each other to form the courses that constitute the wall or the like. The table can also be mounted for rotation or have a rotary part so as to permit blocks to be laid along a curved line to form a curved course. Once a wall has been formed in the table assembly it is gripped at its four sides and swung into an inclined or vertical position for transportation away from the apparatus.

The block placing assembly 14 is adapted to grip blocks individually, and to place these in their proper positions in the table assembly 12. The block placing assembly can be utilized to press the blocks against each other in each course and against blocks in the previously-laid course.

The block feeding assembly 16 transports blocks to the block placing assembly 14, and moves each block into an exact position where it can be picked up by the block placing assembly. The term "block" is intended to include bricks, concrete blocks and any other building units that are placed one on top of the other in courses to form wall-like structures. Although it is preferable to handle the blocks individually, it is to be understood that two or more blocks may be pre-assembled and secured together into a unit. In this case, apparatus 10 will handle such units in the same manner as single blocks, and the term "block" or "block unit" are intended to includes these.

As the blocks are laid up on the table assembly, mortar or other adhesive material is applied to the opposed ends of the blocks in each course and to the edges of the courses facing each other. The term "mortar" is intended to includes any suitable adhesive material that may be used for this purpose. The mortar may be applied directly to the block surfaces, or it may be preformed into appropriate adhesive strips which are moved into place between the block surfaces where required. For example, mortar may be made up in strips of the correct lengths to fit between the ends of the blocks and between the courses. Such a strip may, for example, consist of parallel face layers of open-mesh wire with a relatively stiff mortar mix therebetween and having spacers so that when the strips are placed between the blocks and the blocks pressed together, mortar will not be squeezed out from between the blocks. The formation of these strips and the applicator means for these or for straight mortar constitute a separate invention and, therefore, will not be described herein. As the mortar could actually be applied by hand, the method of application of the mortar or the mortar strips is not necessary to understand the present invention.

TABLE ASSEMBLY 12

Table assembly 12 includes a relatively long and wide base 25 having a pair of tracks 26 extending longitudinally thereof parallel to a center line 28. A lower carriage 30 is positioned above base 25 and extends transversely thereof, and has wheels 31 mounted thereon and riding on tracks 26. Suitable means is provided for moving this carriage back and fourth along the tracks 26 in the direction of center line 28. For example, a chain 33 may be provided for this purpose. This chain is connected at 34 to one edge of the carriage and extends around a tail sprocket 35 and from there back beneath the carriage to a drive sprocket 36 which is rotated by a suitable motor 37. From sprocket 36, the chain extends and is connected to the opposite edge of carriage 30 at 39. Motor 37 is reversible so that it can shift the lower carriage back and forth on tracks 26. A pair of tracks 40 are mounted on carriage 30 adjacent its opposite edges and extend at right angles to track 26. Tracks 40 extend parallel to a center line 42 which is normal to center line 28.

An upper carriage 45 has wheels 46 mounted thereon riding on tracks 40 of the lower carriage. Suitable means is provided for shifting carriage 45 back and forth on rails 40. For example, a chain 48 is connected to an end of the carriage at 49, this chain extending outwardly to tail sprocket 50 and then back under the carriage to a drive sprocket 51 of a reversible motor 52. The chain then extends back to the opposite end of the upper carriage to which it is connected at 53.

If it is desired to form curved courses with this apparatus, a turntable 56 is mounted on carriage 45 to rotate around a central shaft 57. This turntable is rotatable back and fourth around shaft 57, suitable power means being provided for this purpose. In this example, a rack and pinion drive is provided, comprising a rack 60 which is reciprocated by a fluid cylinder 61, the piston of which is connected to the rack. Rack 60 meshes with a pinion gear 62 fixedly mounted on shaft 57. Energization of cylinder 61 causes turntable 56 to rotate in the desired direction.

A base plate 65 is fixedly mounted on turntable 56, and a table 66 lies on this base plate and is connected thereto by hinges 68 at adjacent edges thereof. Each hinge 68 is spaced inwardly from the edge 69 of table 66, see FIG. 1, whereas said hinges are located at the edge of base plate 65 so that when the table is swung out of its normal horizontal position, it is stopped in the vertical position shown in broken lines in FIG. 1, A rectangular frame 72 rests on the top of table 66 and is releasably secured thereto in any suitable manner, such as by a plurality of clamps 74, each of these clamps having a horizontal finger 75 overlying the adjacent side of frame 72 and a vertical section 76 extending from its finger down through a hole in table 66 where a spring 77 urges the clamp in the downward direction. Frame 72 is provided with one or more lifting lugs 80 projecting from the side thereof remote from hinges 68.

Clamping bars 82 and 83 are positioned inside frame 72 at adjacent two angularly arranged sides 84 and 85, respectively, of the frame. Bar 82 is carried by shafts 86 which extend through openings in the adjacent frame side 84. These shafts are movable to shift the bar 82 away from and towards the frame side and the shafts are moved in any desired manner. For example, they may have nuts threaded on their outer ends for manual manipulation, or they may extend into fluid operating cylinders 87 bearing against side 84 and which can be suitably energized to shift the clamping bar inwardly and outwardly with respect to the frame. Similarly, clamping bar 83 is carried by shafts 89 extending through the adjacent side 85 of the frame into an operating cylinder 90 which is energizable to shift bar 83 away from and towards the adjacent frame side.

With the arrangement just described, table 66 can be shifted back and fourth along center line 42, and along center line 28. In addition, the table can be turned to positions at angles to these center lines.

BLOCK PLACING ASSEMBLY 14

The block placing assembly includes a head 95 secured to the lower end of the piston rod 96 projecting from a fluid operated cylinder 97. Cylinder 97 is carried by a suitable frame 98 which is above and extends over table 66. The head 95 has one or more suction cups 99 projecting downwardly therefrom, the number of these cups depending upon the size of the cups and the size of the block units to be handled by the apparatus. The cups 99 are connected to a hose 100 which extends through rod 96 and out from the upper end thereof, said upper end projecting outwardly from the end of cylinder 97. Hose 100 is connected to a suitable source of suction, not shown.

A lever 105 is swingably mounted on a pivot pin 106 carried by frame 98, and is connected near one end thereof to cylinder 97, said lever radiating from the cylinder. The opposite end of the lever is connected to the piston rod 108 of a fluid cylinder 109 which is operable to swing the lever back and forth around pin 106, thereby moving cylinder 97 and head 95 through an arc centered on pin 106.

A platform 110 is normally positioned directly beneath head 95 and above table assembly 12. This platform is slidably mounted on a pair of spaced rails 111 mounted on frame 98 and is moved back and forth on these rails by fluid cylinder 112 on frame 98 and having a piston rod 113 projecting from an end thereof and connected to platform 110. This platform has opposed side walls 114 and 115, and an end wall 116, the opposite end of the platform being open as indicated at 117.

Cylinder 97 can be operated to move head 95 downwardly to press suction cups 99 against a block unit positioned on the platform 110. After suction has been applied to cups 99 through hose 100, cylinder 97 is energized to raise the gripped block off the platform. Then cylinder 112 is energized to shift the platform out of the position aligned with head 95, following which cylinder 97 is energized to move the head downwardly to deposit the gripped block on the table 66 therebeneath of assembly 12. While the block is still gripped by the cups, cylinder 109 can be energized to swing lever 105 and consequently head 95 around pin 106 thereby shifting the gripped block against previously deposited blocks on the table.

After the suction has been released, head 95 is raised above the level of platform 110 and the latter is shifted by cylinder 112 back in position directly beneath the head.

BLOCK FEEDING ASSEMBLY 16

The purpose of block feeding assembly 16 is to supply blocks in succession to platform 110 and to position these blocks properly on said platform. A smooth-surfaced conveyor 120 is carried by frame 98 and is positioned to convey blocks to a stop or fence 122 which extends across the conveyor near platform 110, see FIGS. 6 and 7. This conveyor is aligned with the open side 117 of the platform.

A pair of laterally spaced arms 128 are mounted for vertical swinging movement on pivots 129 projecting from an overhead carriage 130, this carriage being located above conveyor 120 and being suspended from a trolley 134 having wheels 135 riding on overhead rails 136 supported on frame 98. Trolley 134 is moved back and forth along rails 136 in any suitable manner, such as by a fluid cylinder 137 mounted on frame 98 and having a piston rod 138 connected to the trolley. Arms 128 project forwardly from pivots 129 to ends 139 located near fence 122. Each arm end 139 carries a gripper 142 consisting of cylinder 143 having a piston rod 144 projecting from an end thereof inwardly of its respective arm 128 and having a head 145 on its free end, see FIG. 7. The opposite ends 148 of arms 128 are connected to a rod 149 projecting from a fluid cylinder 150 mounted on carriage 130. Energization of cylinder 150 moves ends 148 of arms 128 up and down to move the opposite ends 139 of the arms down and up.

A fluid cylinder 156 is mounted on a support 157 extending between arms 128 spaced back from the ends 139 thereof. This cylinder extends longitudinally parallel with the arms and has a piston rod 160 projecting therefrom having a pusher 161 on its outer end. Cylinder 156 is energizable to shift pusher 161 back and forth.

The blocks are placed on conveyor 120 in any suitable manner, usually face down. These blocks may be placed on the conveyor by hand, or they may be directed thereto by chutes or suitable conveyors, not shown. The blocks are placed with there ends adjacent the side edges of the conveyor. When a block is moved by conveyor 120 against fence 122, the conveyor is stopped. This may be accomplished by an operator, or it may be done automatically in any desired manner, such as by means of a limit switch, not shown, mounted in the fence and operated by the block when it contacts the latter. With the gripper heads 145 retracted, carriage 130 is moved forwardly by cylinder 137, and this moves arms 128 forwardly until their ends 139 span the block on the conveyor, following which the gripper cylinders 142 are energized to press heads 145 against the block ends. The fence 122 has squared the block on the conveyor, and the gripper heads position it crosswise of the conveyor. After cylinder 150 has been energized to raise the arm ends 139 with the block gripped therebetween, carriage 130 is again moved forwardly to shift the block through the open end 117 of platform 110 and onto the latter, said block being pressed by this action against end wall 116 of the platform. The gripper heads 145 are relaxed a little, following which cylinder 156 is energized to move pusher 161 against the block to shift it firmly against the platform end wall 116, gripper heads 145 acting as guides at this time. This action locates the block in exactly the correct position on the platform.

With the block contained in this manner on platform 110, head 95 of the placing assembly 14 is lowered to cause cups 99 to grip the block. Gripper heads 145 and pusher 161 are retracted and then withdrawn from platform 110 so as to be ready for the next block moved against fence 122 by the conveyor. Cylinder 112 is now energized to shift platform 110 from beneath head 95 thus clearing the way for the head to move downwardly to deposit the gripped block on the table of assembly 12.

OPERATION

As stated above, feeding assembly 16 delivers the blocks one at a time, straightens these blocks into proper alignment and shifts the blocks onto platform 110. Gripping head 95 of block assembly 14 picks up the aligned block and deposits it on the table of assembly 12.

As the block is moved by conveyor 120 against fence 122, arms 128 are moved into position overlapping the ends of the block and grippers 142 operate to grip anc position the block laterally with respect to the conveyor, said block having been moved into the correcı angular position relative to the conveyor by fence 122. The arms 128 lift and then shift the block over ontc platform 110 and act as side guides while pusher 161 presses the block against end wall 116 of the platform, these elements retaining the block in the exactly correct position while head 95 is lowered to cause its suction cups 99 to grip the block. After the block has been raised, platform 110 is shifted laterally from beneath the head, and then the latter deposits the block in table 66 of assembly 12.

At the beginning of the wall forming operation, table 66 is shifted to bring the corner 175 of frame 72, see FIG. 9, directly beneath the head in the proper position to receive the first block which is deposited upon table 66 by the head 95. Lever 105 is moved at this time to cause the head to shift the block exactly into the corner of the frame on the table.

As the head is returning for another block, table 66 is shifted laterally along center line 42 a distance equal to the length of one block. As a result of this, the next block is placed in line with the first-placed near an end thereof. Mortar is placed against the end of the first block before or after the second block is moved into place. This mortar may be applied by hand, or it may be ejected thereon by apparatus moving across the end of the block, not shown. After the second block has been deposited on the table, lever 105 is moved to cause head 95 to swing around pivot pin 106 and thereby move the second block in the direction of the first block. This movement is just sufficient to press the mortar against the adjacent ends of the blocks, but is not sufficient to squeeze mortar out from between the blocks. If desired, spacers, not shown, may be included in the mortar to prevent the blocks from being pressed too close together. In addition to this, the second block can be moved into place before the mortar is applied to the end of the first block. In this case, a space is left between the ends of the two blocks and into which mortar is injected.

The depositing of blocks in this manner continues until a line or course of these blocks in formed on table 66 within frame 72 between bar 82 and the frame side opposite said bar. Following this, the table assembly is shifted along center line 28 a distance equal to the height of the blocks being used. Mortar or a mortar strip usually is placed along the surfaces of the blocks forming the first course which is spaced away from the adjacent frame side. The mortar may be applied by hand or automatically, but as this does not form part of the present invention, it will not be described herein. In fact, the mortar may not be applied until after the next course has been laid. If desired, reinforcing rods or a tensioning cable may be laid over the mortar-receiving surface of the first course and held in place while the next course is being laid. Following this, a number of blocks are individually deposited on the table to form a second course.

These operations are continued until the table is covered by the deposited blocks, frame 72 being of such a size as to form a wall of predetermined dimensions. After the last course has been laid, clamping bars 82 and 83 are shifted inwardly sufficiently to grip the formed wall in the frame. A hoist may now be used to grip lifting lugs 80 of the frame to swing it and table 66 into a vertical position, as shown in broken lines in FIG. 1.

Clamps 74 are now swung away from their positions gripping the frame to free the latter from the table. The frame containing the formed wall can now be transported to a curing area and from there to storage or to a building site where the wall is required.

If it is desired to form walls having an opening therein, such as a window or door opening, an additional frame of the required opening size and shape is placed on table 66 in the desired position. Then the blocks are laid in the manner described above on the table between frame 72 and the secondary frame positioned on the table within the main frame. The secondary frame helps to retain the blocks in position when the wall is lifted off the table through frame 72.

If it is desired to form one or more curved courses of blocks, the blocks are deposited as described above, but turntable 56 is rotated as desired so as to rotate the table, resulting in the blocks being laid along a curved line.

FIG. 10 diagrammatically illustrates a completed wall 185 that has been formed on table 66 within frame 72. This wall consists of a plurality of courses 187, each formed by a plurality of blocks 188. The wall has a door opening 190 therein which is headed by an arch 191. The blocks 188 are laid in the courses 187 as described above, while arch 191 is formed by rotating the table after each block has been laid therein. The placing of the blocks can be controlled by a computer programmed for the purpose.

I claim:

1. The method of automatically laying block units to form a substantially horizontal wall-like structure comprising picking up a block unit by a gripping head, placing said block unit on a substantially horizontal movable table at a predetermined position, laterally shifting said table from said predetermined position to clear the head from the placed block unit a distance substantially equal to the length of said block unit, picking up another block unit by the head and placing it at said predetermined position beside the first-mentioned block unit, continuing the picking up, lateral shifting and placing operations until a predetermined number of block units are placed side by side in a first course, shifting said table in the direction normal to said lateral shift a distance substantially equal to the width of said block unit, continuing the picking up, lateral shifting and placing operations to form a second course of block units against said block units of said first course, and continuing the picking up, lateral and normal shifting, and placing operations to form a predetermined number of courses to form a substantially horizontal wall-like structure of said block units of predetermined dimensions.

2. The method of automatically laying block units to form a substantially horizontal wall-like structure comprising picking up a block unit by a vertically movable gripping head, depositing said block unit on a substantially horizontal movable table at a predetermined position, laterally shifting said table from said predetermined position to clear the head from the placed block unit a distance substantially equal to the length of said block unit, picking up another block unit by the head and depositing it at said predetermined position beside the first-mentioned block unit, continuing the picking up, lateral shifting and depositing operations until a predetermined number of block units are placed side by side in a first course, shifting said table in the direction normal to said lateral shift a distance substantially equal to the width of said block unit, continuing the picking up, lateral shifting and depositing operations to form a second course of block units against said block units of said first course, and continuing the picking up, lateral and normal shifting, and depositing operations to form a predetermined number of courses to form a substantially horizontal wall-like structure of said block units of predetermined dimensions.

3. The method as claimed in claim 1 comprising the steps of placing sealing means against the end of each block unit in a course before the next block unit in the same course is moved into place, and placing sealing means against the surface of the block units in each course before the block units of the next following course are moved into place.

4. The method as claimed in claim 2 comprising the steps of placing sealing means against the end of each block unit in a course before the next block unit in the same course is moved into place, and placing sealing means against the surface of the block units in each course before the block units of the next following course are moved into place.

* * * * *